United States Patent [19]

van 't Slot

[11] 4,435,879

[45] Mar. 13, 1984

[54] MODELLING OR PACKING DEVICE FOR FOWL

[75] Inventor: Kornelis van 't Slot, Uddel, Netherlands

[73] Assignee: Moba Holding Barneveld B.V., Barneveld, Netherlands

[21] Appl. No.: 388,658

[22] Filed: Jun. 11, 1982

[30] Foreign Application Priority Data

Jun. 17, 1981 [NL] Netherlands ..... 8102913

[51] Int. Cl.[3] ..... A22C 21/00

[52] U.S. Cl. ..... 17/11; 53/529

[58] Field of Search ..... 17/11, 1 R; 53/529, 53/527

[56] References Cited

U.S. PATENT DOCUMENTS 3,864,787 2/1975 Mosterd ..... 17/11

4,147,012 4/1949 van Mil ..... 53/572 X

*Primary Examiner*—Willie G. Abercrombie

*Attorney, Agent, or Firm*—Larson and Taylor

[57] ABSTRACT

A device for moving two members (6, 18) the one (6) for pushing the body of a poultry and the other (18) for pushing the legs of the poultry against its body, said two members being connected to two pivot arms (2, 12) by means of links (5, 16) one (12) of said arms being connected to a driving means (15) and said arms being mutually coupled by means of at the one hand a curved control slit (4) and at the other hand a control member (14) protruding into said slit, which is so formed that at the end of the stroke of the directly driven arm (12) the other is almost at a stand still.

4 Claims, 3 Drawing Figures

MODELLING OR PACKING DEVICE FOR FOWL

The invention relates to a device for dressing a poultry, provided with a first pushing member adapted to push the body of the poultry in a fixed direction and a second pushing member adapted to push the ends of the legs of the poultry in nearly the same direction to lay the said legs against the said body, provided with a driving mechanism for both pushing members which causes these members to carry out a forward and backward stroke, wherewith the second pushing members moves faster than the first one at the end of the forward stroke.

Such a device is known from the Dutch Patent Application No. 7702628, U.S. Pat. No. 4,147,012 corresponding thereto.

With this known device each of the pushing members needs its own driving means. If one tries to derive the driving movement of both pushing members from a single prime mover it appears to be difficult to realize a sufficient retardation or even stand-still of the first pushing member at the end of the forward stroke of the second pushing member and nevertheless obtain a smooth working of the whole.

The invention aims to provide a solution which is of simple construction and enables a very good driving of both pushing members from a single prime mover and consequently a fast working of the total dressing device.

Accordingly the invention provides that each pushing member is coupled to a different one of two pivotable arms having different pivots wherewith a member having a control slit is connected to one of the said arms and a control member fitting in said slit is connected to the other of said arms, said slit having a first portion which is directed mainly radially with respect to the pivot of the arm connected to the member having the control slit and a second portion that is mainly tangentially directed with respect to said pivot, one of the said arms being connected to a driving means to be pivoted about its pivot.

It is remarked that from the Dutch Patent Application No. 7112520, corresponding U.S. Pat. No. 3,811,245, a construction for packing a poultry in a bag is known in which a curved slit is used with which a linear movement is transferred into a pivot movement that in the beginning is slower than later on. Not a single indication is to be found for two members, driven by one driving member and moving in the same direction but with quite different velocity functions.

When the control member moves in the said first portion of the slit both arms are pivoted almost equally, whereas with moving in the said second portion, which is directed mainly tangentially the arm that is connected to the control member carries out a considerably larger movement than the arm connected to the member that contains the control slit.

An important advantage of the invention is that not only the velocity of both arms can be realized according a desired pattern but that moreover moving backward of the one arm is prevented by the other one.

A further elaboration of the invention gives the possibility to provide that the one pushing member stands still when the other carries out the end of its forward stroke. This gives a smooth working for instance if, as is the case in the above mentioned Dutch Patent Application the dressing occurs when the poultry is already for a major portion located in a bag. Then the possibility exists to have the poultry already pushed into the bag with its body when the pushing-on of the legs occurs, which gives rise to less friction with the bag's wall at the latter movement.

For obtaining the possibility that one of the pushing members stands still when the other moves further on it is provided according to a further embodiment of the invention that the second portion of the slit is a circle arc having as centre the pivot of the arm which is connected to the control member in the position in which the control member is in the said second portion of the slit.

When the control member finds itself in the second portion of the control slit it can move through this portion wherewith however the member that contains the control slit does not move further or is even prevented to pivot because the control member is in the slit.

When applying the invention, specially if high working speeds are desired, it may be important not to change the speed of movement of both members too quickly. Therewith is pointed to the fact that the member that is directly driven does not give rise to difficulties but that the member that pushes against the poultry's body during the forward stroke has to be submitted to a braking action to a velocity of almost zero.

An embodiment of the invention, with which this braking action is sufficiently obtained to prevent jerks and nevertheless the velocity of the pushing member pushing against the body of the poultry is relatively high, consists in that the transition from the first portion unto the second portion of the control slit occurs at one side of the slit with a radius of curvature of almost zero and at the other side with a radius of curvature that corresponds to the diameter of the control member.

Because the control member rolls over the portion of the control slit wall having a radius of curvature of almost zero (in practice it may be simply an corner edge), by reason of this rolling action nevertheless a gradual velocity decrease of the member pushing against the body of the poultry occurs.

An embodiment of the invention which in practice performs well is characterized in that the pivot point of the arm connected to the second pushing member is located beyond the pivot of the arm connected to the first pushing member seen in the direction of movement of the forward stroke and at a greater distance from the working lines of the pushing members, wherewith the arm connected to the second pushing member is driven pneumatically and supports the control member which protrudes into the control slit.

In practice this embodiment has lead to a smoothly running machine with easy mounting and room for the driving mechanism.

In the following the invention is elucidated on hand of the drawing in which.

Figure 1:
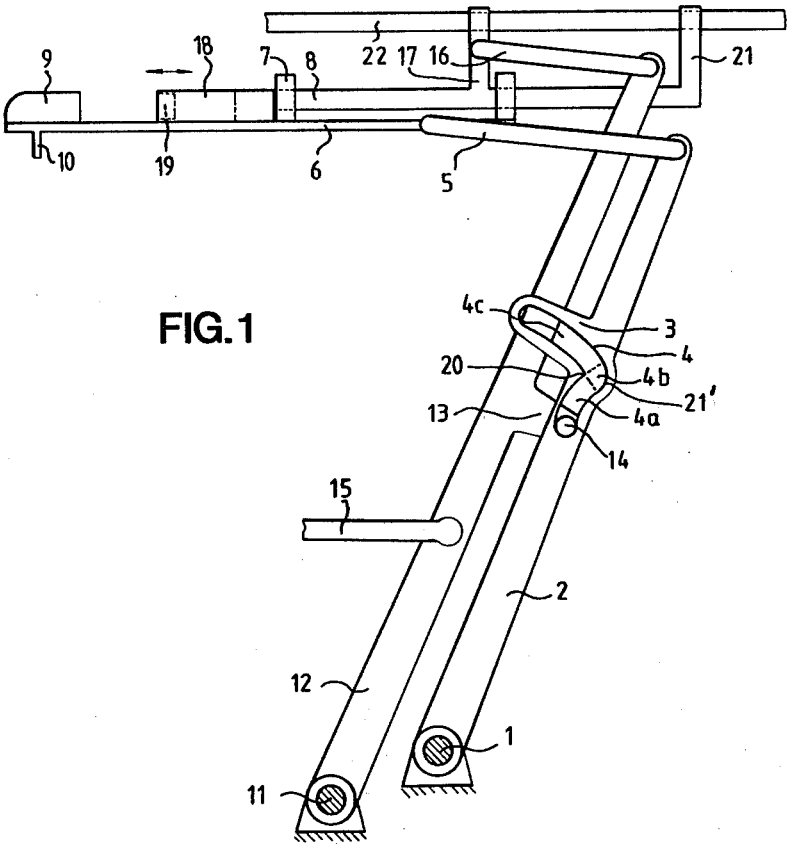
FIG. 1 shows schematically a device according to the invention in its starting position.

In the drawing reference 1 indicates a pivot about which an arm 2 can pivot having a member 3 with a control slit 4 and being at its upper end coupled to a link 5. This link is connected to a pushing member 6. This member is by means of suspending brackets 7 suspended on a glide rod 8, which itself can move lengthwise as will be elucidated further on. At the end of the pushing member 6, which at its upper side is provided with a plane surface a central baffle 9 is located and at the lower side a transverse baffle 10. Such like pushing members have been shown in the copending Dutch Patent Application Nos. 8102372; 8102373 and 8102374. Of course the invention is also applicable to pushing members of different construction, for instanace those shown in the mentioned Dutch Patent Application No. 7702628 to Stork.

Obliquely below the pivot 1 the pivot 11 is located about which an arm 12 can pivot which via a transverse member 13 supports a control member 14 fitting in the control slit 4 and which is driven by a member 15 movable in horizontal direction, for instance the moving member of a pneumatical cylinder. At its upper end the arm 12 is coupled to a link 16, which via a suspension arm 17 is connected to the glide rod 8. The suspension arm 17 and the corresponding suspension arm 21 can glide on a fixedly mounted support rod 22. The glide rod 8 bears at its forward end a pushing member 18 that at both sides of the baffle 9 is provided with two cups 19 for receiving the ends of the legs of a non shown poultry.

The working of the depicted device is the following: Starting from the position of FIG. 1 the driving member 15 is moved toward the left by reason of which arm 12 pivots counter clockwise which causes via link 16 the pushing member 18 to move toward the left.

Because the control member 14 finds itself in the first portion 4*a* of the control slit 4 arm 12 is therewith taken along, the curvature of the portion 4*a* giving the possibility to have the movement of the members 6 and 18 occur with a desired mutual relation, wherewith it is clear, however, that both members move in any case with velocities of the same order.

Figure 2:
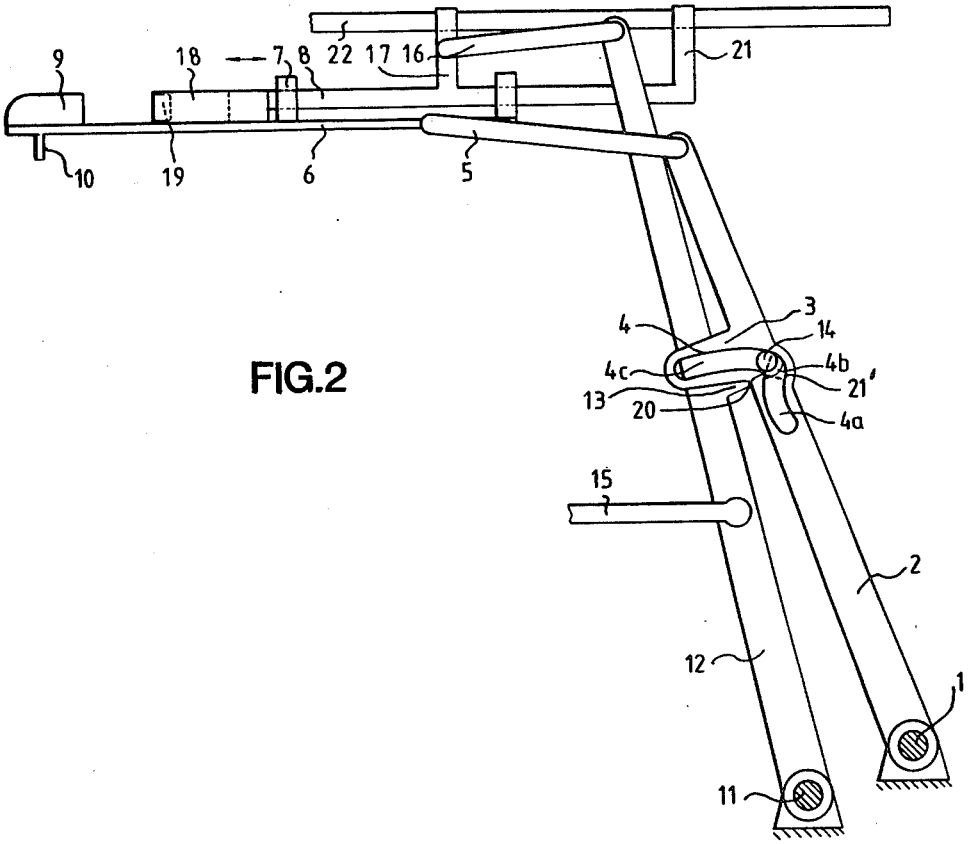
FIG. 2 shows the same device in a further position.
Figure 3:
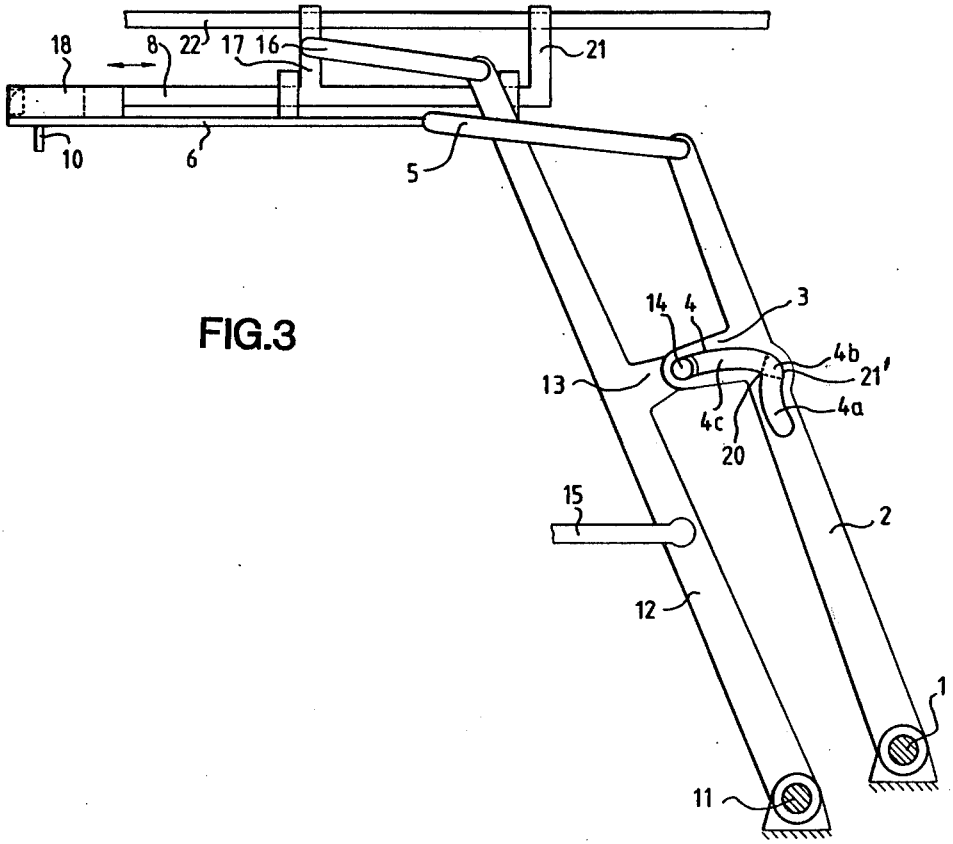
FIG. 3 shows the same device in the final position.

If now the end of the first portion 4*a* of the control slit 4 is reached one begins with the transitional portion 4*b* that is limited by the interrupted lines. This portion 4*b* at one side is limited by an edge or a portion 20 having a radius of curvature of almost zero and at the other side by a circle arc 21′ which arc has the edge 20 as circle centre and a radius that corresponds to the diameter of control member 14. When this control member moves over the edge 20 the arm 2 begins already to retard considerably and when it has passed the portion 4*b* the arm 2 practically is at a stand still, because at that moment (vide FIG. 2) the control slit is a circle arc having as centre the pivot 11. In this portion 4*c* of the control slit the arm 2 cannot pivot about its pivot 1, because the direction of the control slit portion 4*c* is not perpendicular to the line connecting the centre of the control member 4 with the axis of pivot 1. By reason hereof pivoting back of arm 2 is excluded. When now control member 14 moves further through slit portion 4*c* the arm 12 can pivot without pivoting of arm 2, so that pushing member 18 moves whereas pushing member 6 stands still.

The described device gives a jerk free and smooth operation with only one driving member and allows in principle for high working speed.

The radius of curvature of the portion 4*b* is in practice equal to the diameter of the control member 14 that has been carried out as a curve bearing that of course preferably is rotatable about its own axis. Theoretically it equals the sum of the radius of curvature of the edge 20 and the diameter of the control member 14. Consequently it is also possible to realize a somewhat more gradual transition between the portions 4*a* and 4*c* by rounding also the edge 20. This gives only a small extension of the duration of the retardation of arm 2, but has at the other side the advantage that a sharp edge such as 20 which has to transfer forces in the long run may cause fretting. It will be clear that the described mechanism is simple and efficacious and therewith specially designed for pushing a poultry for dressing it up, the first pushing member 6 with as active parts the forward edge of 6 and the parts 9 and 10 being able to push the poultry in a dressing member or a bag and the pushing member 18 laying the legs against the body.

The shown pushing members have the advantage that in the cups 19 and by reason of the baffle 9 each leg has its own guiding means which simplifies pushing the legs. Such pushing members are described in the copending Dutch Patent Application No. 8102374. The invention is, however, also applicable and of interest for differently shaped pushing members.

What I claim is:

1. Device for dressing a poultry, provided with a first pushing member (6) adapted to push the body of the poultry in a fixed direction and a second pushing member (18) adapted to push the ends of the legs of the poultry in nearly the same direction to lay the said legs against the said body, provided with a driving mechanism (15, 12, 16, 14, 4, 2, 5) for both pushing members which causes these members to carry out a forward and backward stroke, wherewith the second pushing member (18) moves faster than the first one (6) at the end of the forward stroke, in which each pushing member is coupled to a different one of two pivotable arms (2, 12) having different pivots (1, 11) wherewith a member (3) having a control slit (4) is connected to one (2) of the said arms and a control member (14) fitting in said slit (4) is connected to the other of said arms, said slit having a first portion (4*a*) which is directed mainly radially with respect to the pivot of the arm connected to the member having the control slit and a second portion (4*c*) that is mainly tangentially directed with respect to said pivot, one (12) of the said arms being connected to a driving means (15) to be pivoted about its pivot (11).

2. Device according to claim 1, in which the second portion (4*c*) of the slit (4) is a circle arc having as centre the pivot (11) of the arm (12) which is connected to the control member (14) in the position in which the control member is in the said second portion of the slit.

3. Device according to claim 1, in which the transition (4*b*) from the first portion (4*a*) unto the second portion (4*c*) of the control slit (4) occurs at one side of the slit with a radius of curvature of almost zero (at 20) and at the other side with a radius of curvature that corresponds to the diameter of the control member (14).

4. Device according to claim 1, in which the pivot point (11) of the arm (12) connected to the second pushing member (18) is located beyond the pivot (1) of the arm (2) connected to the first pushing member (6) seen in the direction of movement of the forward stroke and at a greater distance from the working lines of the pushing members, wherewith the arm (12) connected to the second pushing member is driven pneumatically and supports the control member (14) which protrudes into the control slit (4).

* * * * *

UNITED STATES PATENT AND TRADEMARK OFFICE

CERTIFICATE OF CORRECTION

PATENT NO. : 4,435,879

DATED : March 13, 1984

INVENTOR(S) : VAN'T SLOT

It is certified that error appears in the above-identified patent and that said Letters Patent is hereby corrected as shown below:

In the cover page of the patent, upper left hand side, after "Assignee:" please delete "Moba Holdings, Barneveld B.V., Netherlands" and substitute therefor --ADMINISTRATIE - EN AUTOMATISERINGSCENTRUM VULCAAN B.V., Amsterlveen, Netherlands--

Signed and Sealed this

*Twenty-sixth* Day of *November 1985*

[SEAL]

*Attest:*

DONALD J. QUIGG

*Attesting Officer*

*Commissioner of Patents and Trademarks*